US007540785B1

(12) United States Patent
Zhao

(10) Patent No.: US 7,540,785 B1
(45) Date of Patent: Jun. 2, 2009

(54) ULTRA FINE PITCH CONNECTOR AND CABLE ASSEMBLY

(75) Inventor: Jim Zhao, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/985,128

(22) Filed: Nov. 14, 2007

(51) Int. Cl.
*H01R 24/00* (2006.01)

(52) U.S. Cl. ..... 439/660

(58) Field of Classification Search ..... 439/638, 439/289, 362–363, 91, 660
See application file for complete search history.

(56) References Cited

U.S. PATENT DOCUMENTS 5,176,528 A 1/1993 Fry
5,766,033 A 6/1998 Davis
5,980,308 A 11/1999 Hu
6,447,339 B1 * 9/2002 Reed et al. ..... 439/638
6,793,506 B1 9/2004 Hirata

* cited by examiner

*Primary Examiner*—Jean F Duverne
(74) *Attorney, Agent, or Firm*—Wei Te Chung

(57) ABSTRACT

Provided herewith an ultra-fine cable assembly comprising an insulative housing defining a mating portion and a mounting portion. The housing defines with a plurality of passageway, and each passageway has a slit at mounting portion of the housing. A plurality of contact terminals is assembled in the passageways of housing, with a mating section arranged in the mating portion of the housing, and a tail portion located at the mounting portion of the housing. The tail portion of the contact terminal is arranged to be accessible through the slit provided with a wide-opened space offset from each other. A plurality of coaxial wires is provided and each has an electrical conductor running through the slit and in contact with the tail portion of the contact terminal. A transferring layer is positioned over the mounting portion of the housing and has pre-formed conductive material aligned with each of the tail portion accessible within the wide-open space, and with the preformed conductive material disposed within the wide-opened space.

10 Claims, 15 Drawing Sheets

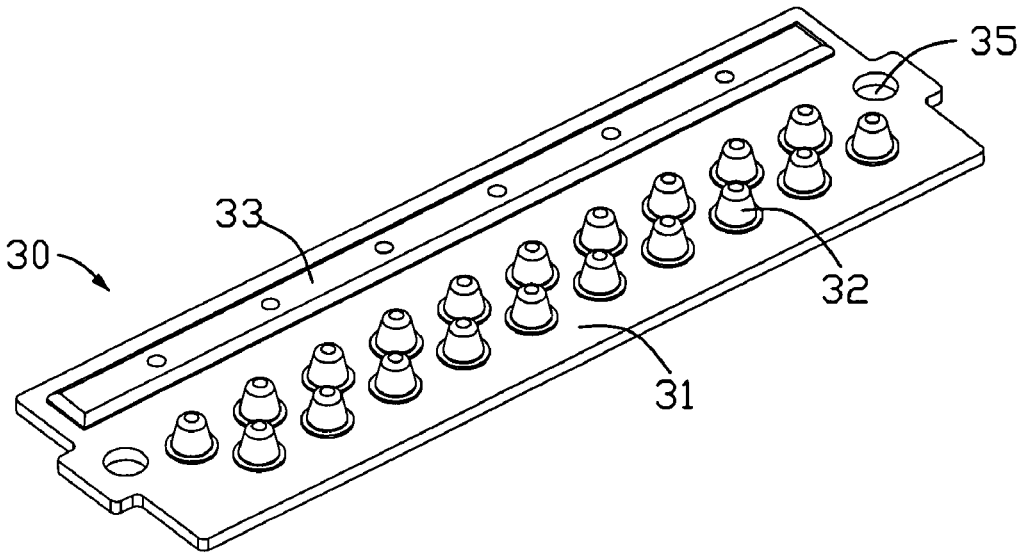
FIG. 3B
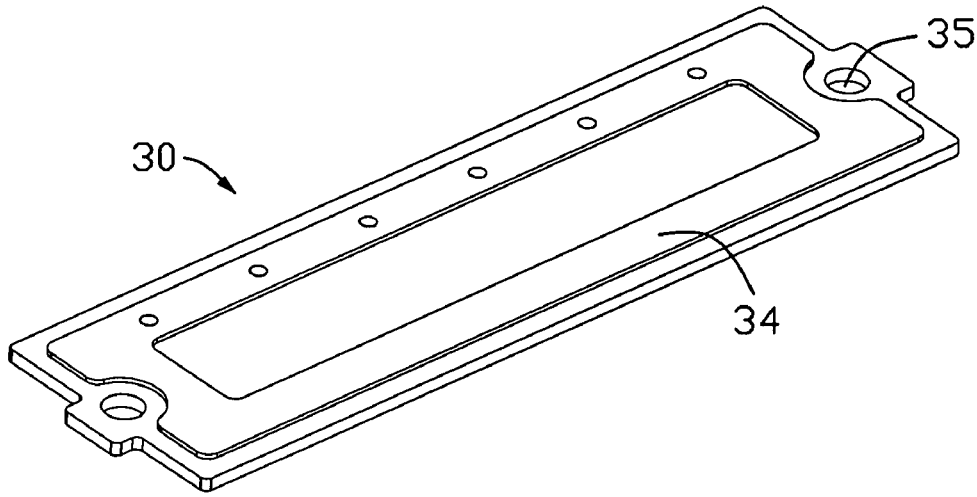
FIG. 3B1

ULTRA FINE PITCH CONNECTOR AND CABLE ASSEMBLY

FIELD OF THE INVENTION

The present invention relates to a cable assembly, and more particularly to a cable assembly of terminating an ultra-fine conductor of a cable to a tail portion of a contact terminal of a connector. The cable assembly features an arrangement such that solderable reflowable material can be limited to certain area benefiting fine pitch and even ultra-fine pitch application. This application relates to a copending application which essentially discloses the same structure while referring to the corresponding manufacturing method making the same.

DESCRIPTION OF PRIOR ART

Male and female electrical connector assemblies have been used for many years in a variety of applications, wherein a plug or male connector is mateable with a receptacle or female connector. A common type of plug and receptacle connector assembly employs pin and socket contacts or terminals.

In most of the applications, the plug connector, which carries a plurality of pins, is mounted on the board, such as a printed circuit board; while the receptacle, which carries a plurality of socket or box contact is terminated to a cable having a plurality of wires which conductors enveloped with insulation. U.S. Pat. No. 5,176,528 issued to Fry on Jan. 5, 1993 discloses both the receptacle connectors, see FIGS. 2, 4 and 5 in which the plug connector is mounted onto the printed circuit board, while FIG. 1 discloses a receptacle connector, right-hand side is terminated to a cable. Of course, the plug connector can also be terminated to a cable.

Termination between contact terminals, either plug or receptacle, and conductors of a cable can be categorized by mechanical, such as bolting, cramping, IDC, and soldering. Before getting more details on the cable assembly of termination, let discuss a little more regarding the dimension of the cable.

Generally, the diameter of a conductor of a wire ranges from 0.5 inches to 0.0010 inches. In order for easily referring those wires with different diameters, a wire gauge, such as American Wire Gauge (A.W.G), has been introduced. For the diameter of 0.5 inches, the AWG No. is 0000000 (7/0), while the diameter of 0.0010, the AWG No. is 50, the small the AWG number, the larger the diameter of the wire, and vice versa. For those wire with larger diameter, they are generally bolted to certain termination, such as switchboard, and transformer; while for those wire with smaller diameter, cramping, such as disclosed in the Fry's '528 patent, soldering, and IDC have been widely applied.

U.S. Pat. No. 5,766,033 issued to Davis on Jun. 16, 1998 disclosed a typical example for IDC termination, as it can be best illustrated by FIGS. 1, 2 and 3. U.S. Pat. No. 6,062,896 issued to Huang on May 16, 2000 discloses a similar IDC termination.

For those conductors directly soldered to the tail portions of the contact terminals, such as disclosed in U.S. Pat. No. 5,980,308 issued to Hu et al. on Nov. 9, 1999; and U.S. Pat. No. 6,206,722 issued to Ko et al. on Mar. 27, 2001. These conductors have been widely associated with liquid crystal display (LCD), and the so-called micro-coaxial cable features an AWG numbers ranging from 34 to 42. The manufacturing processes are extremely laborious, and complicated. In generally, solder paste is directly applied to tail portion of the contact terminal, then the conductors are placed over the solder paste, then heat is applied to make the final joint. However, in the mobile phone and other palm digital device (PDA), the market uses an even small pitch connector, such as 0.4 mm pitch or even 0.3 mm pitch connector. The wire associated with these ultra-fine pitch connector is AWG 42, 0.0025 inches.

While, the consumer electronic device keeps pushing smaller and smaller, it is believed that in near future, cable assembly with wire gauge of 46, i.e. 0.0016 inches, which is approximately one fourth of human hair, or even higher will be applied.

Handling and treatment of such tiny wires is extremely laborious and delicate, and even beyond of imagination by the existing and available termination processes. For example, the smallest diameter of a drop of a solder paste available to the market is about 0.01 inches (about 0.0254 mm), which is comparably larger than the dimension of the wire of AWG 46. As a result, if the connector is further pushed to be featured with a pitch of below 0.3 mm, it is very much likely that wire of AWG of 44, 45, etc need to be applied. Accordingly, termination for those fine, or even ultra fine conductor to contact, is really a challenge to the industry. Unless it is overcome, it is unlikely to see another miniaturization of the consumer electronic devices.

U.S. Pat. No. 5,730,606 issued to Sinclair teaches the use of solder attached to contact tails. U.S. Pat. No. 4,678,250 issued to Romine on Jul. 7, 1987; and U.S. Pat. Nos. 6,024,584 and 6,042,389 issued to Lemke on Feb. 15, 2000 and Mar. 28, 2000 disclose a pre-formed solder mass attached to the contact tail of the connector. Specially, Lemke disposes solder mass and or solder paste within a well and or recess.

U.S. Pat. No. 6,793,506 issued to Hirata et al. on Sep. 21, 2004 discloses a so-called board-to-board connector, which generally have a 0.4 mm pitch. Soldering these fine-fine pitch connectors onto printed circuit board is sill doable since the solder paste can be deployed onto the footprint by stencil. However, if someone wants to attach cable or printed circuit onto this ultra-fine pitch connector, at least when the present invention is conceived, there is no doable processes available in the market.

Once the wire used become smaller and smaller, such as AWG 44 and beyond, there is also a concern that whether the solder joint formed during reflown is robust and durable. Accordingly, it is would be preferable that at least two electronic bonding can be formed between the tail portion of the contact and the conductor of the wire so as to ensure the durable electrical interconnection can be reached and ensured.

Nevertheless, in view of the dimension of the AWG 44 and beyond, it is unlikely to attach a preformed solder mass onto a tiny wire, which has merely one fourth of our human hair based on the existing termination technologies.

SUMMARY OF THE INVENTION

An object of the present invention is to provide a cable assembly for terminating ultra-fine conductor to a tail portion of a contact terminal in which reflowable conductive material administered onto two adjacent tail portions of the contact terminals are offset from each other thereby allowing ultra-fine solder process to be properly performed.

It is further of the present invention to provide a connector suitable for terminating with an ultra-fine connector in which arrangement is provided adjacent to mounting portion of the contact terminal such that reflowable process of solderable material can be smoothly performed.

According to one and first preferable embodiment of the present invention, an electrical connector comprises an insulative housing defining a mating portion and a mounting portion with a plurality of contact terminals assembled therein. Each contact terminal includes a mating section arranged in the mating portion of the housing, and a tail portion is located at the mounting portion of the housing. A flexible printed circuit is positioned over the mounting portion of the housing and provided pre-formed reflowable conductive material offset from one other attached thereon in alignment with each of the tail portion.

According to one aspect of the first embodiment, the flexible printed circuit is further provided with a ground bar with respect to the preformed reflowable conductive material.

According to another and second embodiment of the present invention, an electrical connector in accordance with the present invention comprises an insulative housing defining a mating portion and a mounting portion, and provided with a plurality of passageway. Each passageway has a slit at mounting portion of the housing. A plurality of contact terminals are integrally formed with the housing, and with a mating section arranged in the mating portion of the housing, and a tail portion located at the mounting portion of the housing. Wherein the tail portion of the contact terminal is accessible through the slit which is further provided with a wide-opened space offset from each other for receiving a reflowable conductive material.

According still to another aspect of a third embodiment of the present invention, provided herewith an ultra-fine cable assembly comprising an insulative housing defining a mating portion and a mounting portion which has a slit defined thereof. A plurality of contact terminals is integrally formed with the housing, with a mating section arranged in the mating portion of the housing, and a tail portion located at the mounting portion of the housing. The tail portion of the contact terminal is arranged to be accessible through the slit provided with a wide-opened space offset from each other. A plurality of coaxial wires is provided and each has an electrical conductor running through the slit and in contact with the tail portion of the contact terminal. A transferring layer is positioned over the mounting portion of the housing and has pre-formed conductive material aligned with each of the tail portion accessible within the wide-open space, and with the preformed conductive material disposed within the wide-opened space.

According to a feature of the third embodiment, wherein the transferring layer further includes a ground bar distant to the preformed conductive mass and in contact with a grounding braiding of each of the coaxial wire.

According to still a feature of the third embodiment, wherein the wide-open space is a cup-shape recess and the conductor is located at bottom of the recess.

According to still a feature of the third embodiment, wherein the tail portion extends out of the passageway.

According to a still feature of the third embodiment, wherein the conductor extends out of the passageway along with the tail portion.

According to still a feature of the third embodiment, wherein a wire end block is attached to the housing to cover the tail end and wire end outside of the slit.

Other objects, features and advantages of the invention will be apparent from the following detailed description taken in connection with the accompanying drawings.

BRIEF DESCRIPTION OF THE DRAWINGS

FIG. 3B is an enlarged view showing the transferring layer in FIG. 1 in up-side-down arrangement;

FIG. 3B1 is a top view of the transferring layer in FIG. 3B;

DETAILED DESCRIPTION OF PREFERRED EMBODIMENTS

Figure 1:
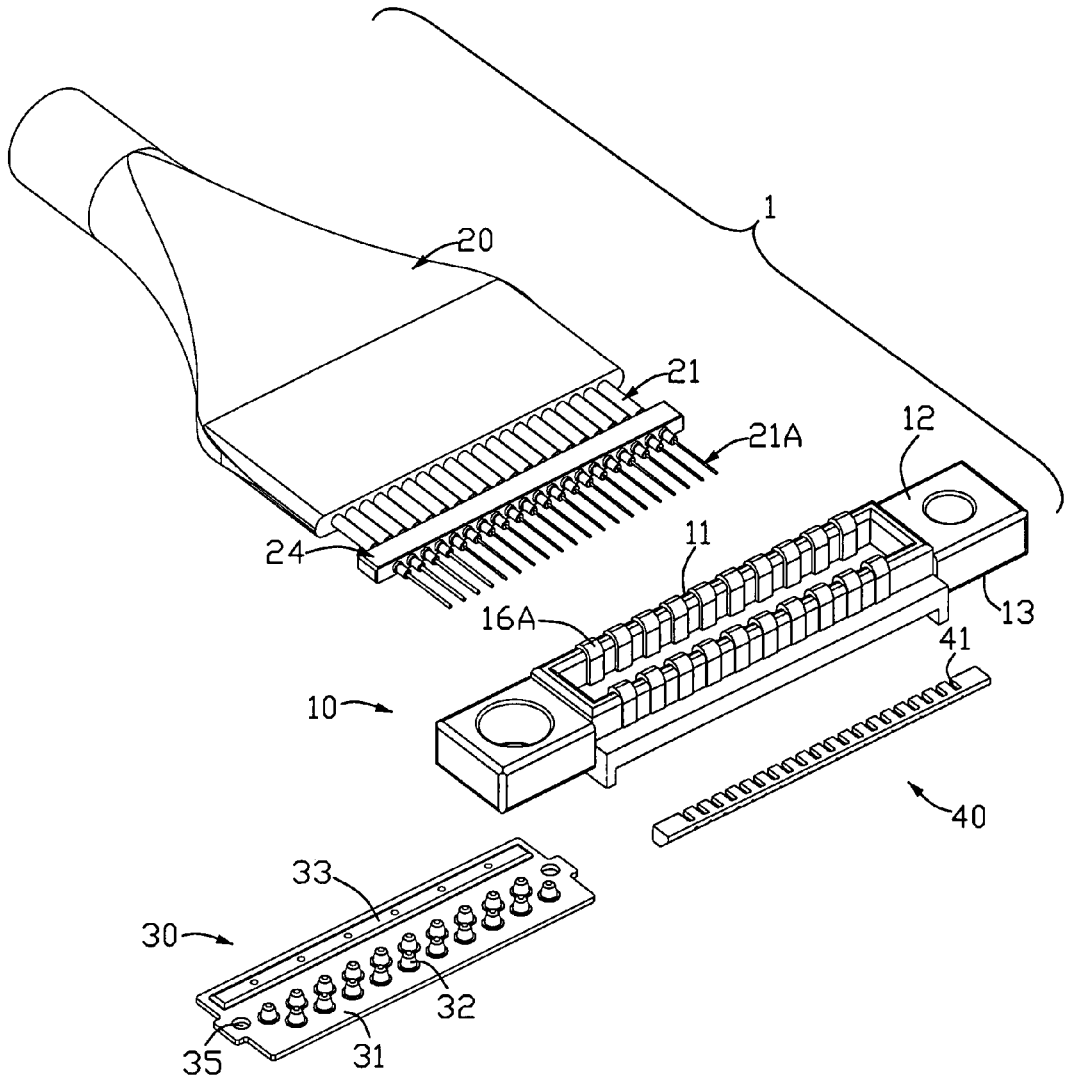
FIG. 1 is a perspective and exploded view of a cable assembly made in accordance with the present invention.
Figure 2:
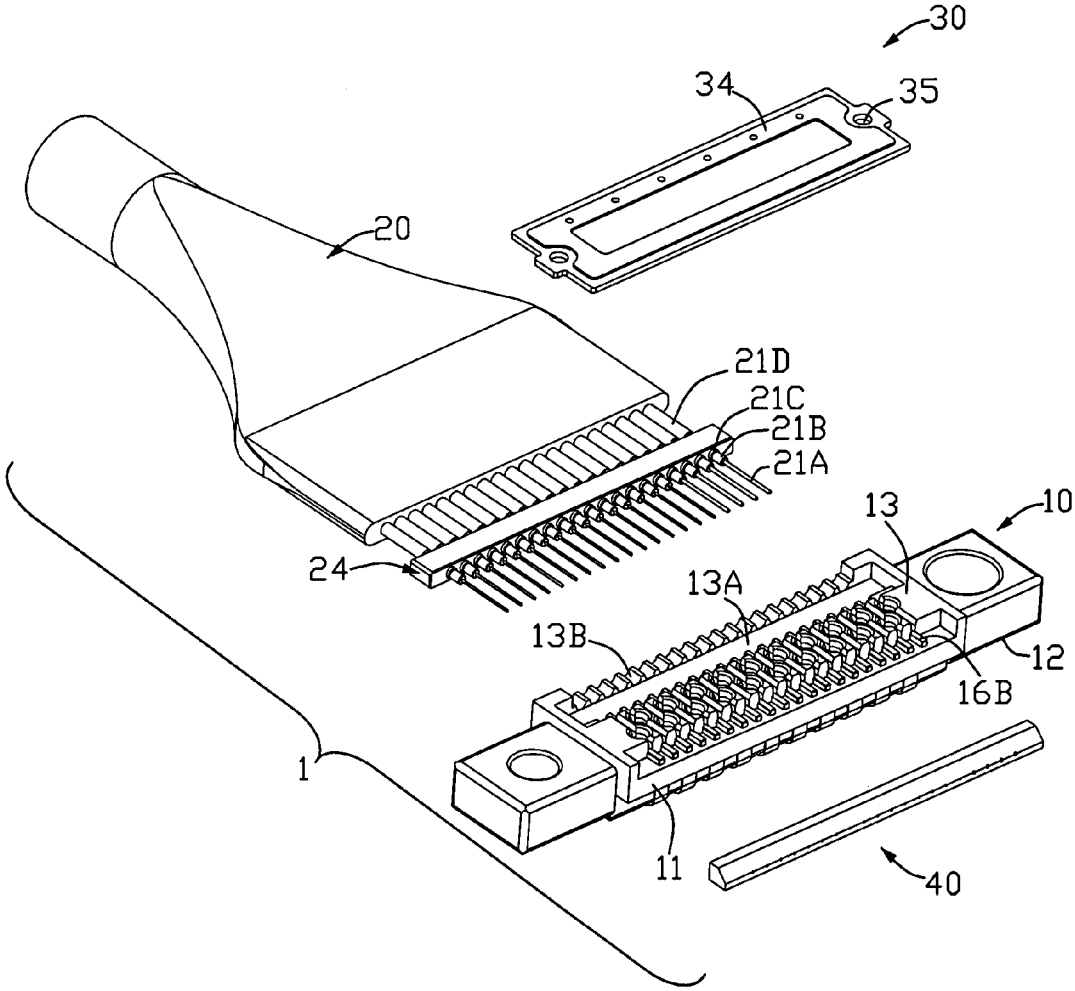
FIG. 2 is similar to FIG. 1, but viewing from bottom of the connector.
Figure 2A:
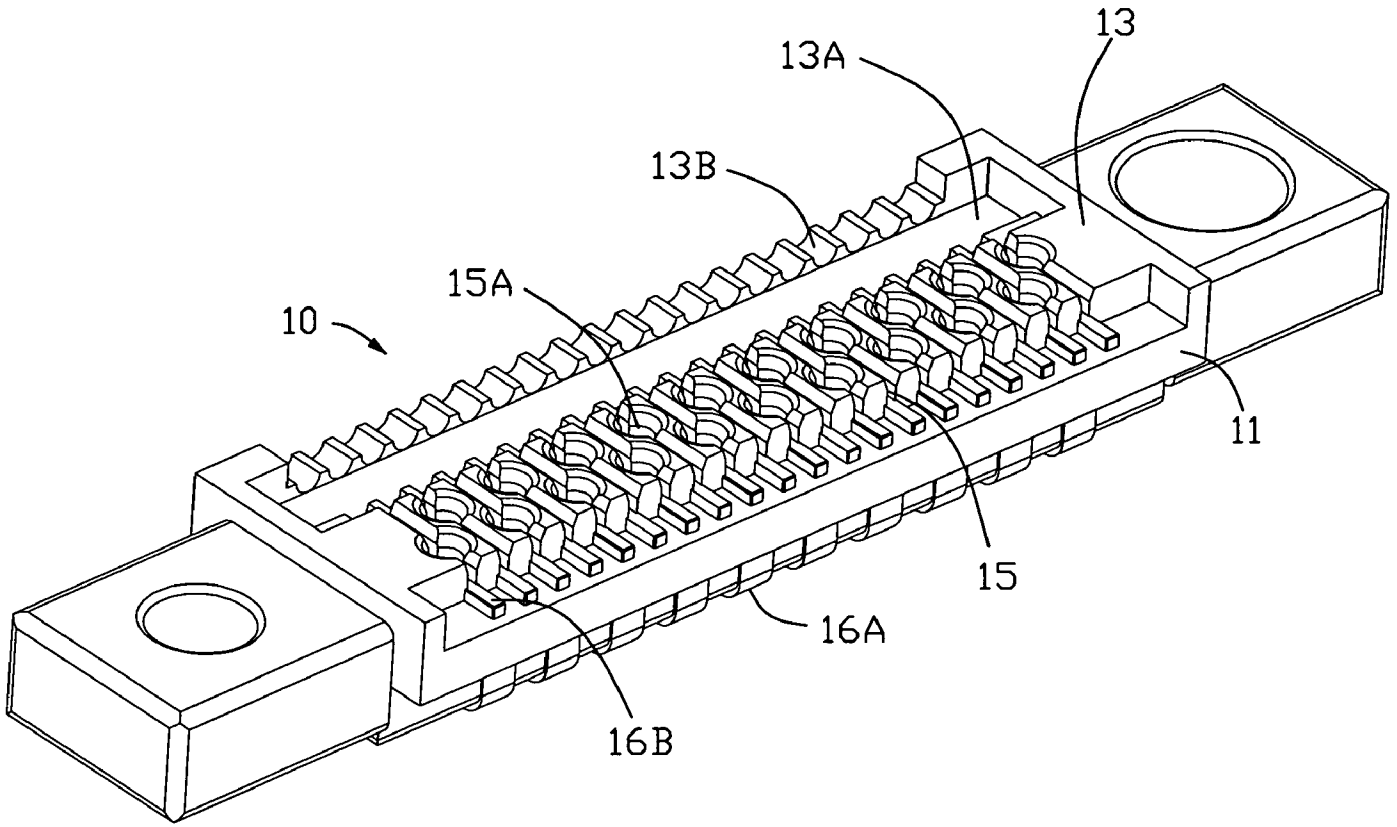
FIG. 2A is an enlarged view of a housing shown in FIG. 2.

Referring to FIGS. 1 through 5, a cable assembly 1 made in accordance with the present invention includes a connector 10, a micro coaxial cable 20 made up by a plurality of micro coaxial wires 21, and a transferring layer 30, and finally a wire end block 40.

The connector 10 can be of any type. In the present invention, a board-to-board connector is used for illustration, while it can be also of the type disclosed in U.S. Pat. No. 5,980,308 issued to Hu et al.; and U.S. Pat. No. 6,206,722 issued to Ko et al. The connector 10 includes an insulative housing 11, defining a mating portion 12 and a mounting portion 13.

Figure 3:
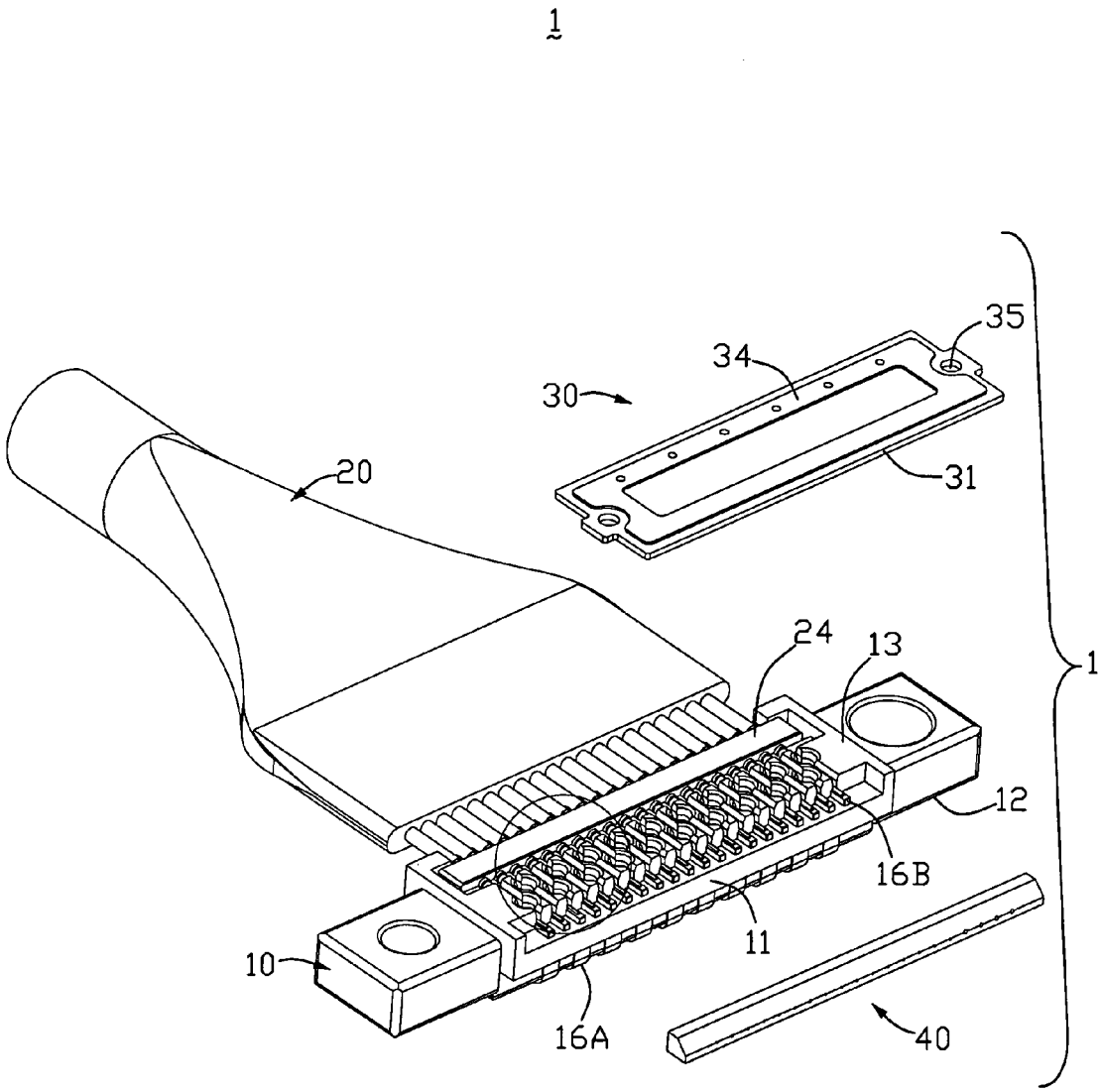
FIG. 3 is an assembled view in which the cable is organized and disposed on the bottom of the connector.
Figure 3A:
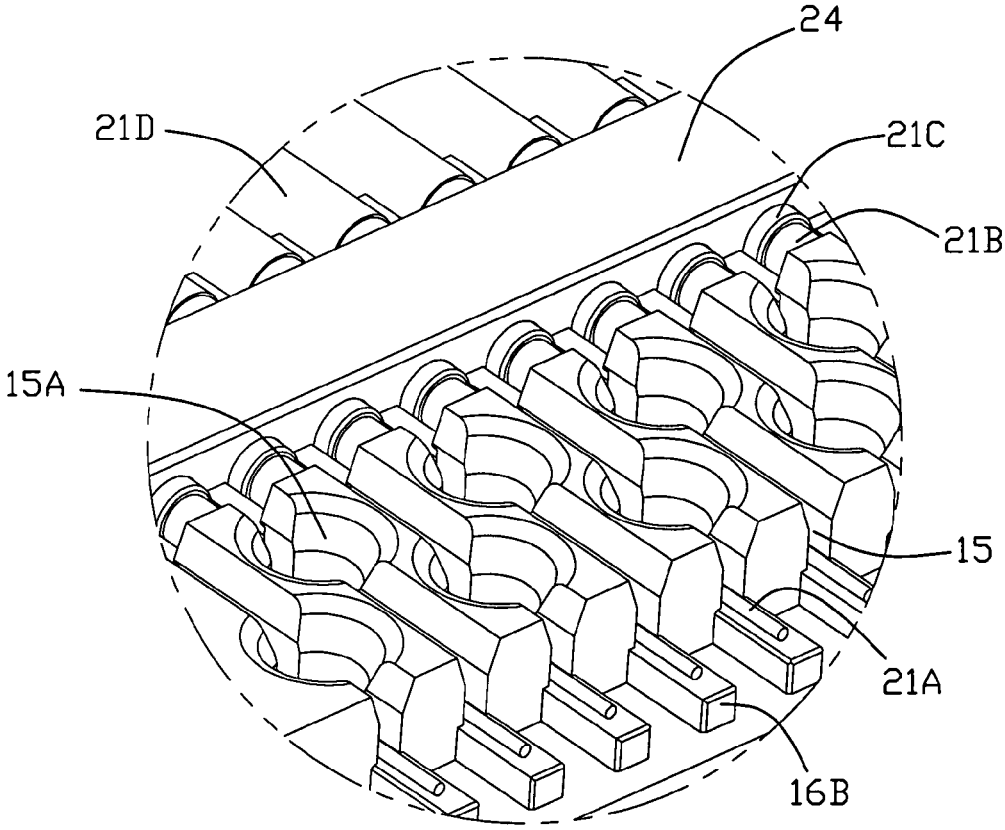
FIG. 3A is an enlarged view illustrating the arrangement between a conductor and a tail portion of a contact terminal.
Figure 3C:
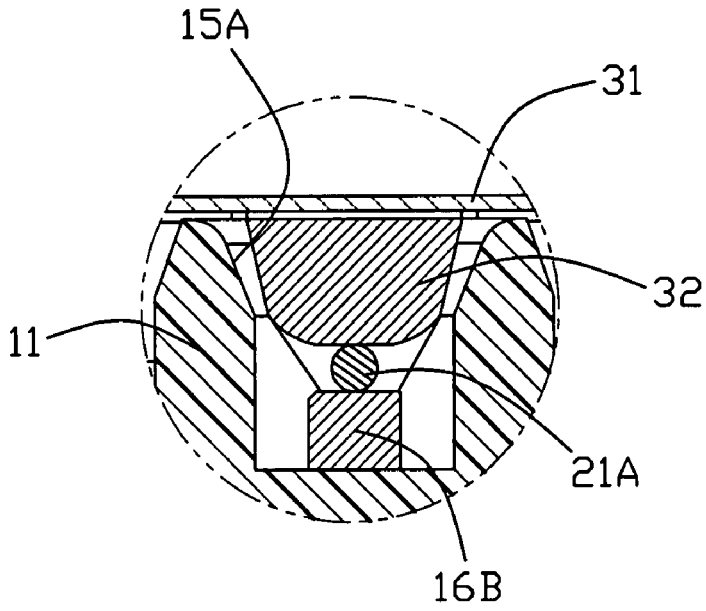
FIG. 3C is an enlarged cross-sectional view showing the well arranged on the bottom surface of the connector along with a solder pre-form disposed above the conductor and the tail portion of the contact.
Figure 3D:
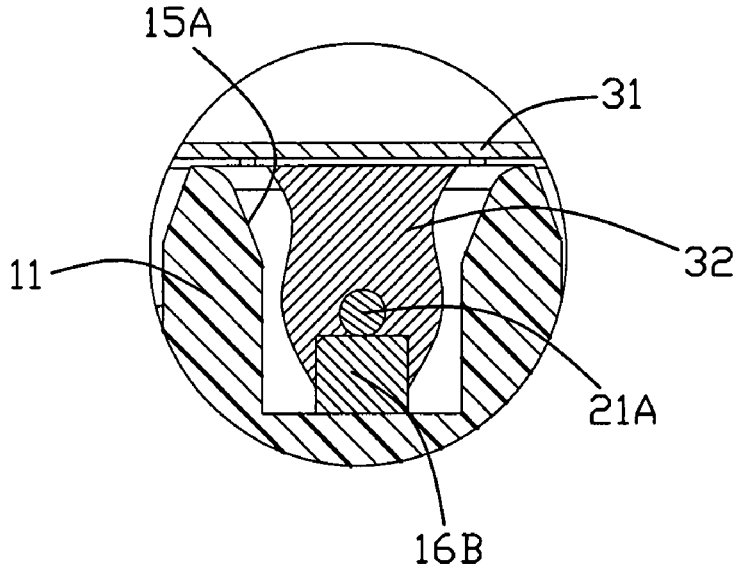
FIG. 3D is similar to FIG. 3C but showing the solder pre-form is reflown and electrically attaching the conductor to the tail portion of the contact terminal.
Figure 3E:
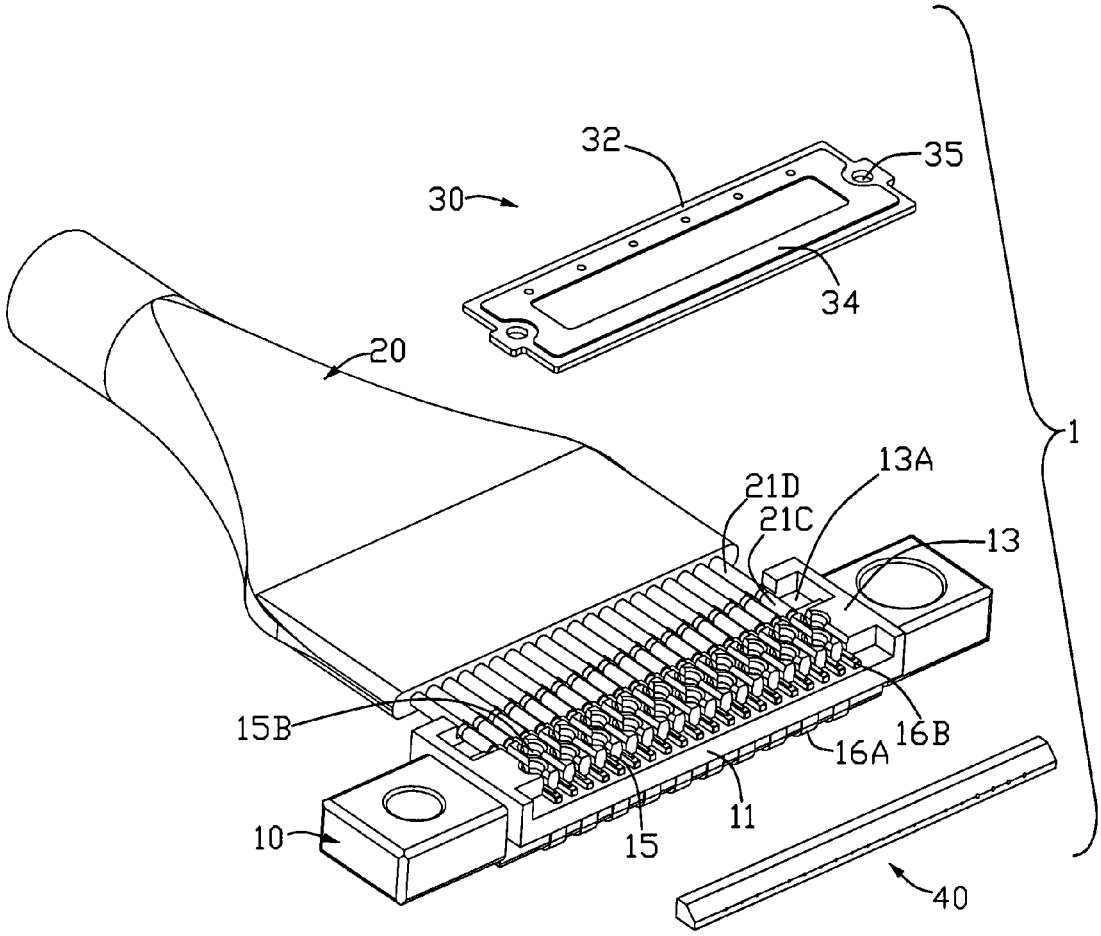
FIG. 3E is a perspective view similar to FIG. 3, while disclosing an alternative embodiment in which the organizer is removed.
Figure 4:
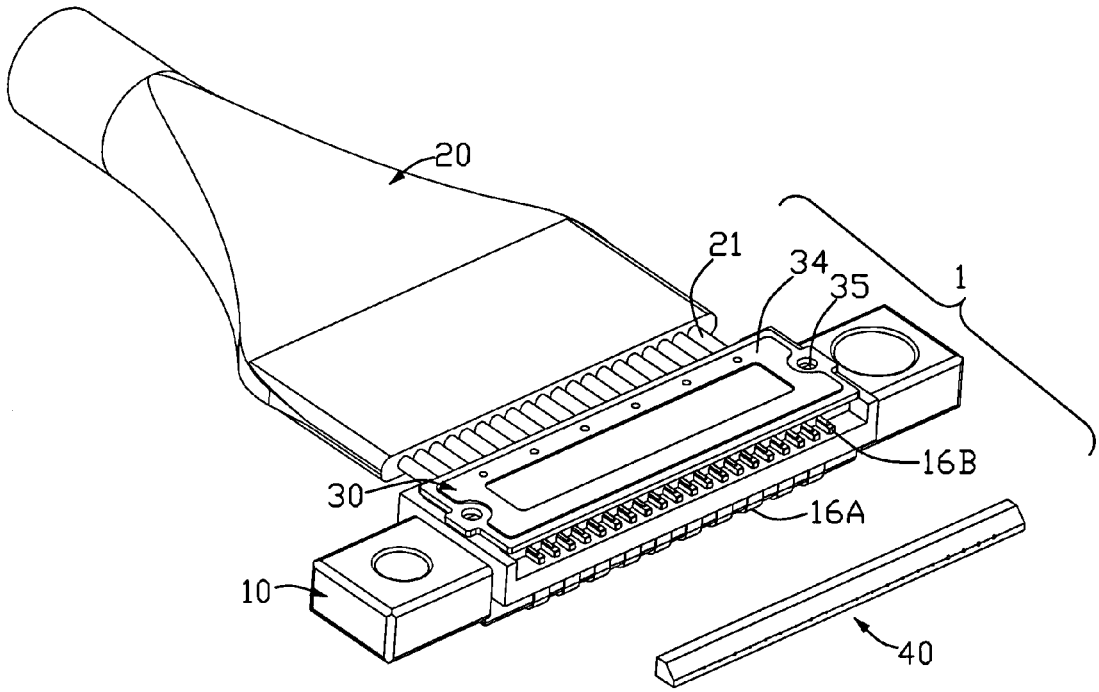
FIG. 4 is a similar to FIGS. 1 and 2, with transferring later assembled to the connector so as to electrical interconnect the conductor with the tail portion.
Figure 5:
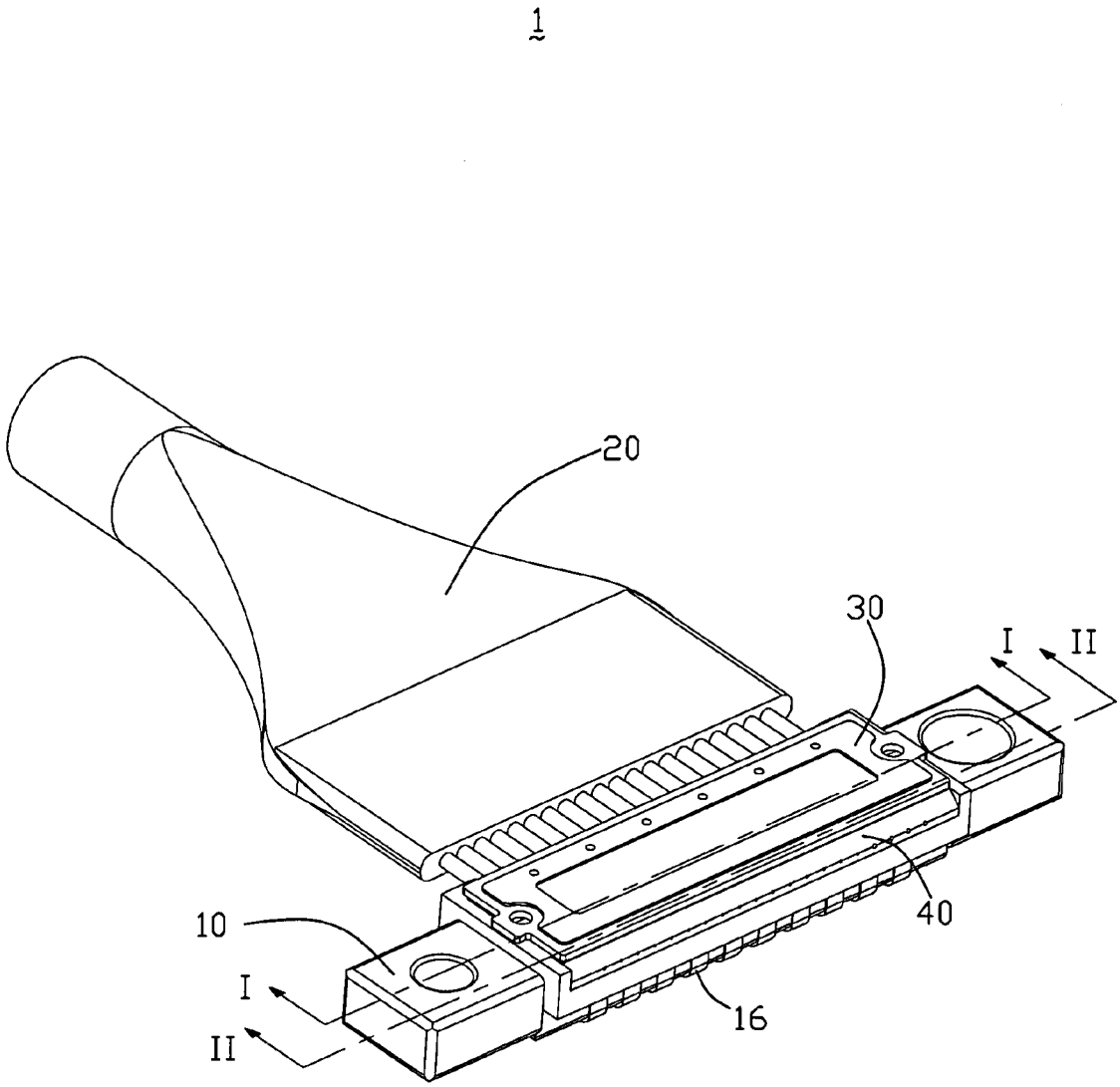
FIG. 5 is similar to FIG. 4, with a wire end block finally attached to the connector to completely cover ends of tail portion and conductors.
Figure 5A:
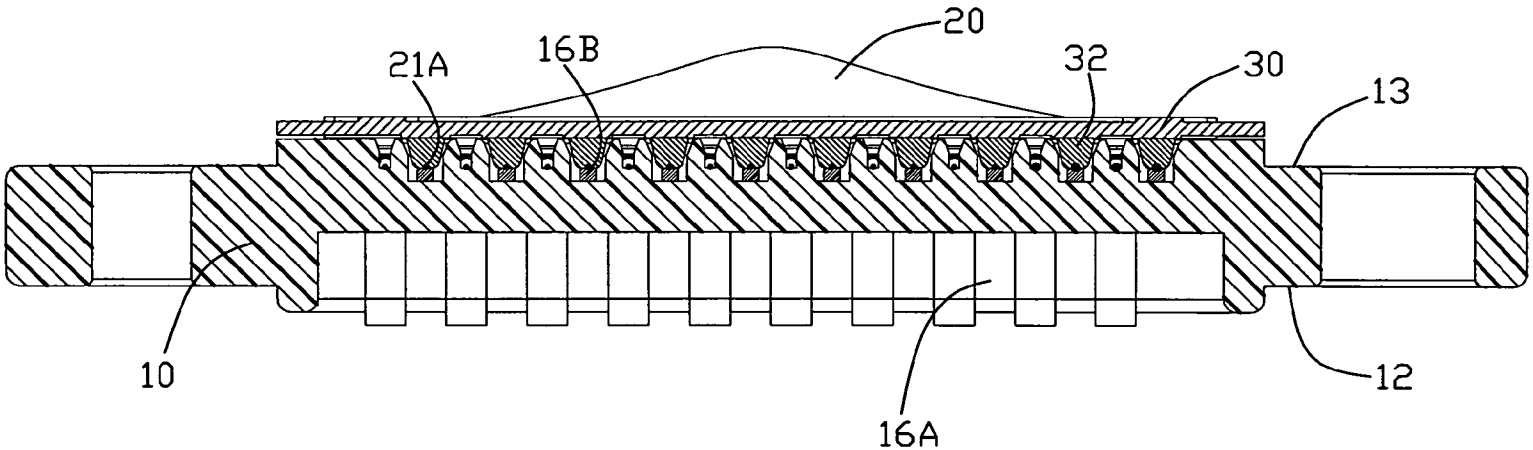
FIG. 5A is a cross-sectional view taken along line I-I of FIG. 5.
Figure 5B:
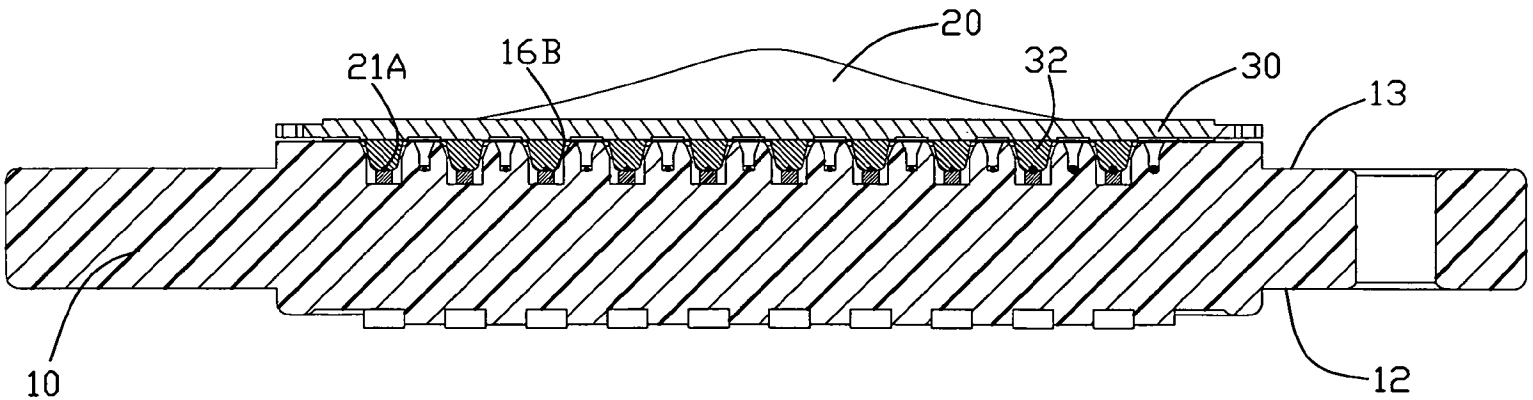
FIG. 5B is a cross-sectional view taken along line II-II of FIG. 5.
Figure 5C:
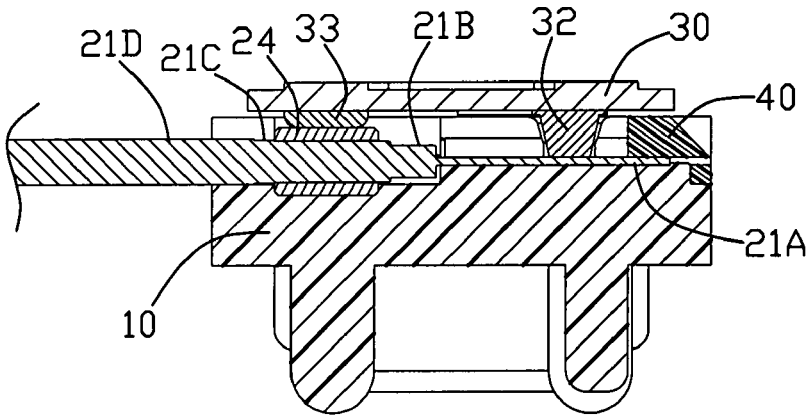
FIG. 5C is a cross-sectional view of a first embodiment made according to the present invention.
Figure 5D:
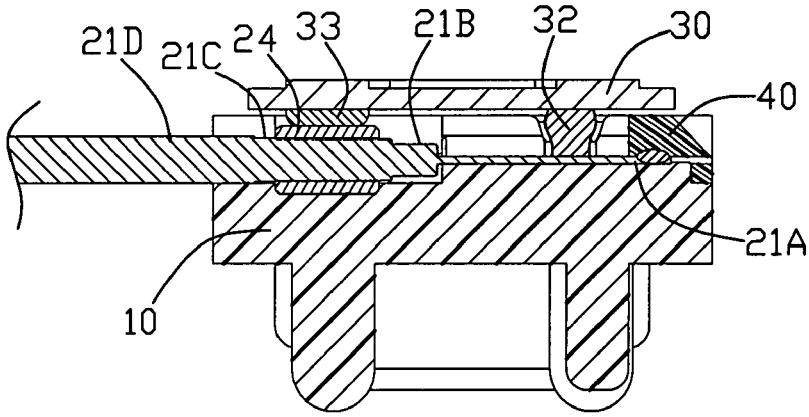
FIG. 5D is a cross-sectional view of a third embodiment made according to the present invention.
Figure 5E:
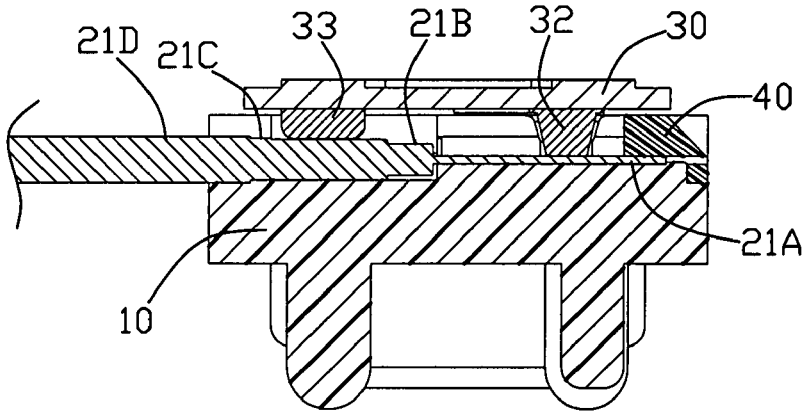
FIG. 5E is similar to FIG. 5C but showing the organizer is removed and the ground bar electrically attaching the braiding of the wire.

Extending therebetween is a plurality of passageway (not labeled). And each passageway has a slit 15 at mounting portion 13 of the housing 11. Each of the slits 15 is provided with a wide-opened space 15A, such as a cup 15A which is comparably larger than the width of the slit 15. As best illustrated in FIGS. 3A and 3C, the cup 15A of each slit 15 is arranged in a manner that every two adjacent cups 15A are offset from each other. By this arrangement, the distance L between two cups 15A is larger than the pitch P between two contacts 16. It should be understood that if the connector 10 is made through process of insert-molding, then the passageway 14 will not apparent as conventional connector. In the present invention, the connector 10 is made from insert-molding, and only a slit 15 is defined at the mounting portion 13 exposing the contact terminal 16. The mounting portion 13 is further defined with a receiving space 13A, and a plurality of notches 13B which has pitch corresponding to the pitch of the contact terminal 16.

A plurality of contact terminals 16 is assembled to each of the passageways of the housing 11 or integrally formed with the housing, with a mating section 16A arranged in the mating portion 12 of the housing 11, and a tail portion 16B located at the mounting portion 13 of the housing 11. Since the passage is provided with a slit 15, the tail portion 16B of the contact terminal 16 in the mounting portion 13 is accessible through the slit 15 and the cup 15A.

The micro coaxial cable 20 is configured by a plurality of coaxial wires 21 each has an electrical conductor 21A, an insulator 21B, a braiding 21C, and a jacket 21D encapsulates the braiding 21C, ad the insulator 21B and the conductor 21A. The wires 21 can be bundled by a coat 22 for easily handling and processing. On the other hand, during the processing, each of the wires 21 is properly disposed within an organizer 24 such that the wires 21 can be pre-arranged to a pitch identical to the pitch of the connector 10, i.e. in this case to the pitch P of the tail portion 16B. Before the conductor 21B can be properly interconnected to the tail portion 16B, the insulator 21B, the braiding 21C, and the jacket 21D have to been stripped off a certain distance so as to expose the conductor 21B. During the assembly, the organizer 24 can be properly and snuggly received within the receiving space 13A defined in the mounting portion 13 of the housing 11, while the cable 20 can be each properly supported by those notches 13B defined on the edge of the mounting portion 13. In addition, according to a preferred embodiment of the present invention, the organizer 24 can be made of conductive material, such as die cast such that the braiding of each wire 21 can be electrically interconnected to enhance the shielding effect.

Once the cable 20 is properly processed, each of the conductor 21A can be properly run through the slit 15 so as to in contact with the tail portion 16B of the contact terminal 16, as shown in FIGS. 3A and 3C. In addition, ends of the tail portion 16B extends outside of the slit 15, and an end of the conductor 21B extends also out of the slit 15 along with the slit 15. However, this exposure of the ends of both the conductor 21A and the tail portion 16B can be finally covered by a wire end block 40. As shown in FIG. 1, the wire end block 40 is defined with a plurality of slots 41 dimensioned to the width of the tail portion 16B of the contact terminal 16. When the wire end block 40 is attached to the housing 11, the tail portion 16B is properly received in each of the slot 41.

One of the features of the first embodiment of the present invention is that the transferring layer 30 is introduced. In the past, solder paste is stenciled onto the tail portion, such as shown in U.S. Pat. No. 5,980,308 issued to Hu et al.; and U.S. Pat. No. 6,206,722 issued to Ko et al. However, administration of solder paste is critical and uncontrollable when creating a ultra fine drop of solder paste. Theoretically, the solder paste has to be in physical contact with the tail portion and adhere thereto. Then when the dispenser is lifted, a certain amount drop of solder paste is left on the tail portion. As discussed in the Description of the Prior Art, it is very difficult and tedious to do this in a mass production. The introduction of transferring layer 30 with preformed solder mass thereon properly resolves this problem.

Accordingly, the transferring layer 30 in accordance with the present invention includes a substrate 31, which can be made of any suitable material, such as paper sheet, Kevlar sheet, etc. Then, pre-formed conductive material, such as solder nuggets 32 are disposed and adhere to the substrate 31 in a pre-arranged pattern which is identical to the cup 15A on the mounting portion 12 of the housing 11 such that when the transferring layer 30 is disposed over the mounting portion 12, each of the solder nugget 32 is in alignment with the corresponding cup 15A and properly received therein. After the transferring layer is properly disposed over the mounting portion 12, properly heating process can be applied to permanently joint the conductor 21B and the tail portion 16B.

On the other hand, it can also apply some mechanic force such that the conductor 21B is pressed to the tail portion 16B, and this can still create a permanent and electrical connection therebetween.

In addition, the transferring layer 30 further includes a ground bar 33 distant to the preformed conductive mass 32 and in contact with a grounding braiding 21C of each of the coaxial wire 21. This also resolve another laborious process as in the existing process, a very tiny lead wire has to be firstly flattened, and then solder to the braiding. It is extremely difficult in view of such a tinny connector and tiny exposure of the braiding. However, then the ground bar 33 is attached to the substrate 31, this problem is smoothly and completely resolved. By the way, the ground bar 33 can be applied onto both surfaces for advanced advantages. The other side of the substrate 31 is then provided with a ground plane 34 which provides further electromagnetic interference (EMI) shielding, providing a continuous EMI from micro-coaxial cable 20 to the connector 10. None of the existing and/or relevant prior art provides such a feature. According to a preferred embodiment of the present invention, the substrate 31 can be facilitated without ground bar 33 if the wire 20 is organized with the organizer 24 which is electrically conductive. Only when the wires 20 are not organized with the organizer 20, then the substrate 31 can be provided with a ground bar 33 so as to electrically interconnect the braiding 31C of the wire 20.

The manufacturing process of the cable assembly 1 in according to the present invention starts from organizing and processing the micro-coaxial cable 20. Each of the wires 21 are prearranged and organized with an organizer 24. The organizer 24 is provided with plurality of through holes (not shown) for receiving therein the wires 21. Then glue or the like can be administered to securely position the wires 21 within the organizer 24. The organizer 24 can be later properly and snuggly disposed within the receiving space 13A so as to properly position the conductors 20 onto the mounting portion 13 of the housing 11.

After the cable 20 is processed with wires 21 are properly held by the organizer 24, firstly jacket 21D is stripped off for a predetermined length. Then a certain braiding 21C is further stripped off from the insulator 21B, and finally a certain length of insulator 21B is stripped and the conductor 21A is finally exposed. Since the conductor 21A is very tiny and slim, care has to be taken so as to prevent the conductors 21A from being broken.

As described above, each passageway has a slit 15 at mounting portion 13 of the housing 11. Each of the slits 15 is provided with a wide-opened space 15A, such as a cup 15A which is comparably larger than the width of the slit 15. The connector 10 is held with the mounting portion 13 held upward. Then, each of the conductors 21A is then aligned and disposed into each of the slit 15 such that the conductor 21A runs through the whole slit 15 and with ends extending outside of the slit 15.

Figure 6:
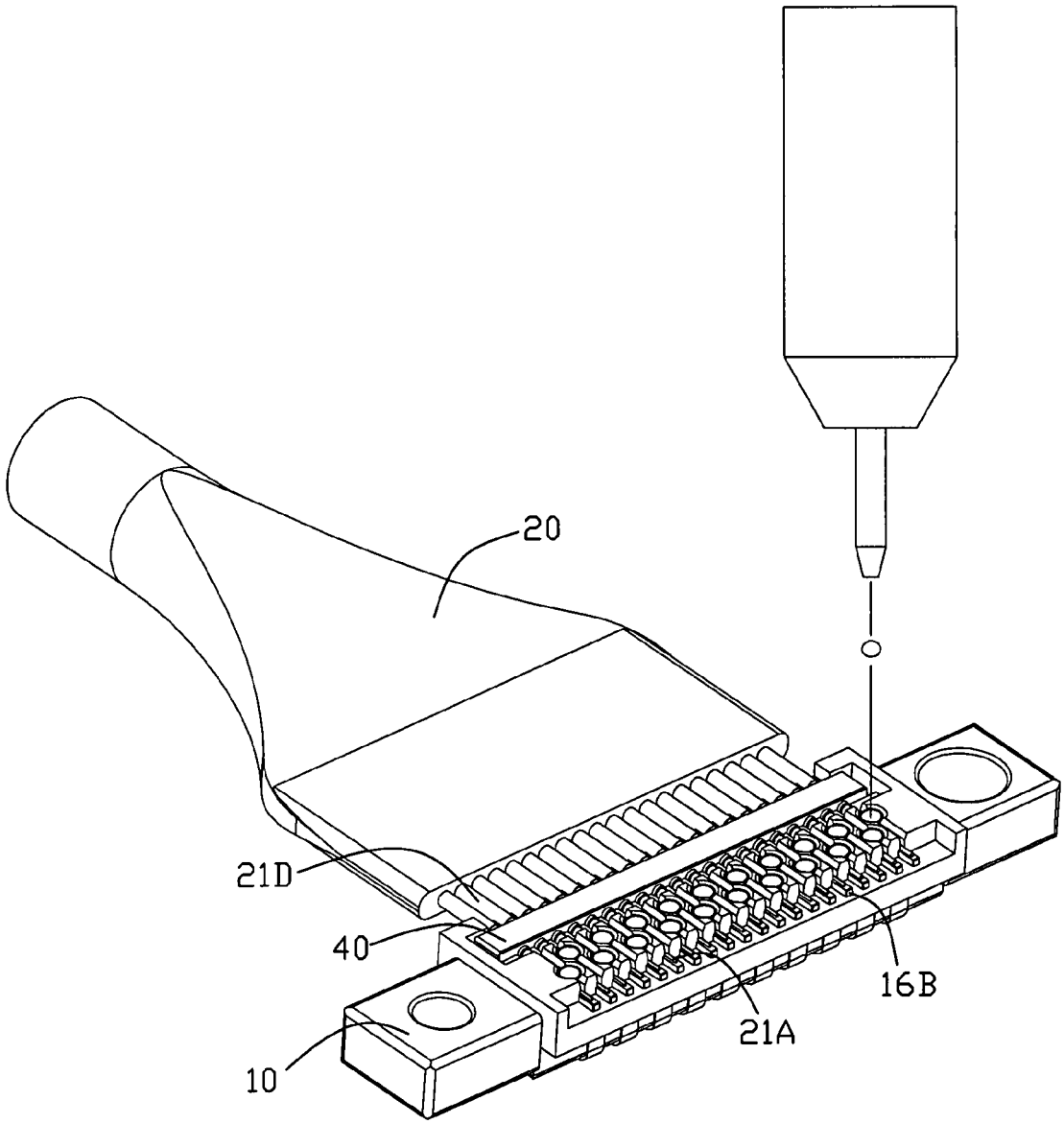
FIG. 6 is an illustration of a second embodiment made according to the present invention.

Once the conductors 21A is properly and smoothly disposed within the corresponding slit 15, a solder paste dispenser, as shown in FIG. 6 can be used to administer a drop of solder paste into the cup 15A. After the solder administration, the connector 10 along with the cable 20 can undergo a heat process so as to reflow the solder paste and eventually, a solder joint will be formed between the conductor 21A and the tail portion 16B of the contact 16. This is one of the manufacturing processes to electrically and mechanically interconnect the conductors 21A and the tail portions 16B.

Alternatively, instead of using solder paste dispenser, the transferring layer 30 can be used. It is really convenient to have the solder mass or nugget 32 preformed onto the substrate 31 of the transferring layer 30. The solder mass or nuggets 32 are disposed over the substrate 31 in a mirror-image manner such that when the substrate 31 is disposed over the mounting portion 13 of the housing 11, each of the nuggets 32 will be properly aligned with each of the cup 15A, and further smoothly received within the cup 15A.

Then after the transferring layer 30 is properly disposed over the mounting portion 13, and with each of the solder nuggets 32 properly received within the cup 15A, then heating process can be applied so as to reflow the solder paste and eventually, a solder joint will be formed between the conductor 21A and the tail portion 16B of the contact 16.

As discussed above, ends of the tail portion 16B extends outside of the slit 15, and an end of the conductor 21B extends also out of the slit 15 along with the slit 15. This is advantageous as heat can be transferred and conduct to the solder nuggets 32 through the exposed ends of tail portion 16B. However, after the process is completed, this exposure of the ends of both the conductor 21A and the tail portion 16B can be properly covered by a wire end block 40.

In addition, ground bar 33 can be also disposed on the substrate 31 with a predetermined distance with respect to the preformed solder nuggets 32. This is specially advantageous as once the solder nuggets 32 properly sit into the cup 15A, the ground bar 33 is also properly aligned and overlapped with the braiding 21C of the wire 21. When the heat process proceeds, solder joint will also be formed between the braiding 21C and the ground bar 33.

Although the preferred embodiment illustrated above using micro-coaxial cable as an example, it should be understood that others can be used as long as it fits its field requirements. For example, a flexible printed circuit can be used to replace the micro-coaxial cable.

In this case, the flexible printed circuit board can be provided with preformed solder nuggets 32, and then properly disposed over the mounting portion 13 of the connector 10 with the solder nuggets 32 properly enter the cup 15A. Then a heat process can be performed to electrically and interconnect the connector 1 and the flexible printed circuit.

On the other hand, for easily and readily handling the placement of the transferring layer 30 over the mounting portion 13 of the connector 10, guiding arrangements, such as dowel post and guiding notch or holes can be used to easy alignment and placement of the transferring layer 30 over the mounting portion 13.

Figure 7:
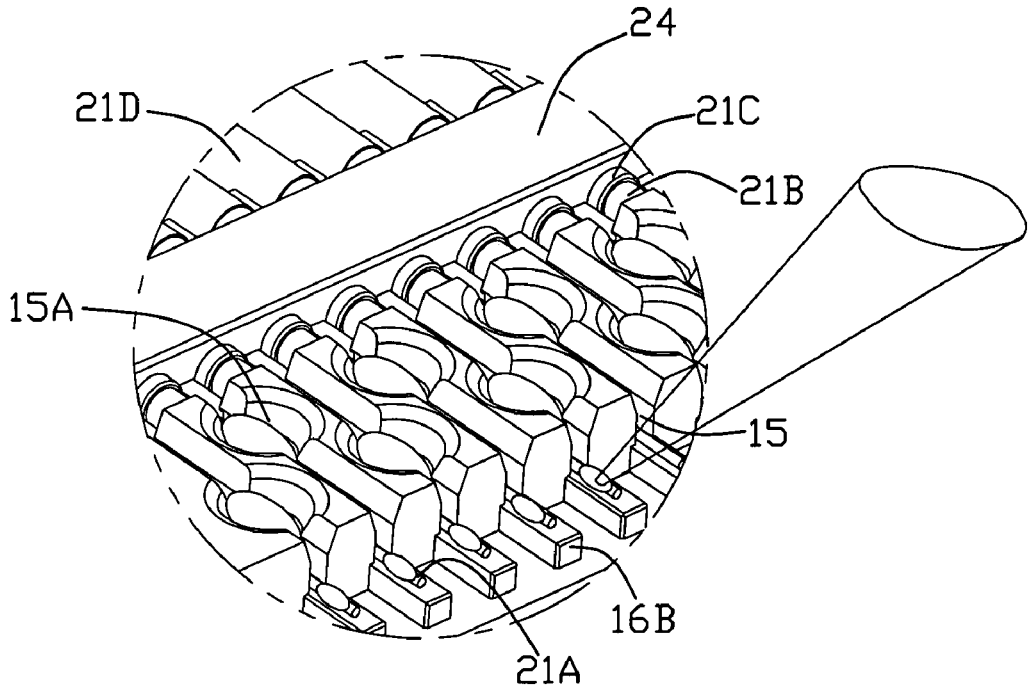
FIG. 7 is an illustration of a third embodiment made according to the present invention.
Figure 8:
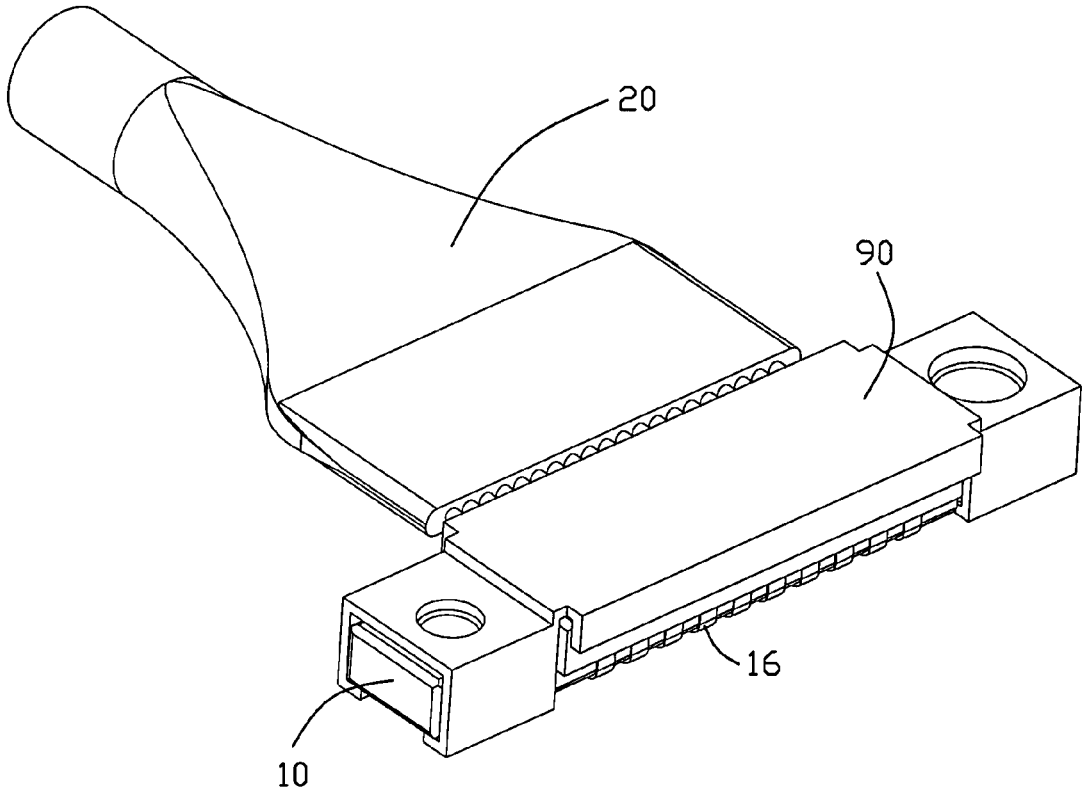
FIG. 8 is an assembled, perspective view of the cable assembly with a metal shell covering the connector in accordance with the present invention.

According to a third embodiment in accordance with the present invention as shown in FIG. 7, the interconnection between the conductor 21A and the tail portion 16B of the contact 16 can be performed by both laser welding as well as soldering. By this arrangement, it features a dual-joint interconnection between conductor 21A and the tail portion 16B of the contact 16. By providing at least two electrical interconnections between the conductor 21A and the tail portion 16B of the contact 16, the concern can be put aside.

As discussed above, ends of the tail portion 16B extends outside of the slit 15, and an end of the conductor 21B extends also out of the slit 15 along with the slit 15. As a result, laser welding of the conductor 21A to the tail portion 16B of the contact 16 can be easily and effectively performed on a fraction of second. Meanwhile, the heat conducted to the tail portion 16B by the laser welding is also high and sufficient enough the reflow the solder nugget 32 previously disposed within the cup 15A. Accordingly, not only the conductor 21B is welded to the tail portion 16B, but also the conductor 21B is soldered to the tail portion 16B around the area within the cup 15A. This dual-joint interconnection ensure robust and durable interconnections for such a tine wire to the connector. As clearly shown in FIG. 7, welding joints are formed on the exposed tail portion 16B, while the solder joint is formed within the cup 15A. As a result, two electrical interconnections are formed between the conductor 21A to the tail portion 16B of the contact 16 ensuring the reliability and durability can be performed by a single laser welding.

As discussed above, the conductor 21A is very tiny, and handling and processing that is tremendously laborious. In order to properly position and place the conductor 21A into the slit 15. Each of the slit 15 is provided with a lead-in edge or chamfer 15B, see FIG. 3C. Accordingly, with an assistance of compressed air toward the conductor 21A, the air pressure from the compressed air can properly direct the conductor 21A to rest onto the tail portion 16B of the contact 16.

The connector 10 made in accordance with the present invention is by way of insert-molding in case of ultra-fine pitch arrangement. As discussed, the cable assembly suggested by the present invention can also be applied to other existing connectors, such as discussed in the Description of the Prior Art, i.e. the contact terminals can be assembled into a pre-molded housing. During the insert-molding process, the slit 15 and the cup 15A are simultaneously formed on the mounting portion 13.

It should be noted that even a micro coaxial cable is used in the preferred embodiment, it should be noted that others can be used as well, such at flexible printed cable (FPC). In this embodiment, then the solder pre-form can be directly disposed on the FPC, and then the connector made in accordance with the present invention can readily sit onto the solder pre-form, and then go through certain process so as to electrically interconnect the FPC and the connector.

The connector 10 of the cable assembly 1 has a metal shell 90 covering the transferring layer 30 and the wire end block 40. The metal shell 90 is provided for enhancing the grounding function of the connector 10 and provides further electromagnetic interference (EMI) shielding, providing a continuous EMI from micro-coaxial cable 20 to the connector 10.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. An electrical connector, comprising:

an insulative housing, defining a mating portion and a mounting portion;

a plurality of contact terminals integrally formed in the housing, with a mating section arranged in the mating portion of the housing, and a tail portion located at the mounting portion of the housing; and the housing provided with a reflowable material receiving arrangement located around the tail portion of the terminal limiting reflowable material, and every two adjacent receiving arrangements being offset from another in every two adjacent tail portions of the corresponding contact terminals.

2. The electrical connector as recited in claim 1, wherein the reflowable material receiving arrangement includes a well in communication with each of the tail portion.

3. The electrical connector as recited in claim 2, wherein the housing further includes a slit running along with the tail portion and in communication with the well.

4. The electrical connector as recited in claim 3, wherein a portion of the tail portion of the contact extends beyond the slit.

5. A cable assembly, comprising:

an insulative housing, defining a mating portion and a mounting portion, a plurality of contact terminals assembled in the housing, with a mating section arranged in the mating portion of the housing, and a tail portion located at the mounting portion of the housing;

a transferring layer positioned over the mounting portion of the housing and having thereon a plurality of pre-formed conductive pieces aligned with each of the tail portion; and a plurality of wires each having an electrical conductor positioned to the transferring layer and in contract with the preformed conductive piece, after heated the preformed conductive pieces jointing the tail portion and the electrical conductor together; Wherein said housing is further equipped with a reflowable conductive piece receiving arrangement to respectively receive and confine the corresponding conductive pieces therein; wherein said reflowable conductive piece receiving arrangement is further provided with a plurality of slits to receive the corresponding conductor therein.

6. The cable assembly as claimed in claim 5, wherein said preformed conductive pieces are offset from one another between the adjacent ones.

7. The cable assembly as claimed in claim 5, wherein said transferring layer is a flexible printed circuit board.

8. The cable assembly as claimed in claim 5, wherein said transferring layer is further provided with a ground bar with respect to the preformed reflowable conductive piece.

9. A cable connector assembly comprising:

an insulative housing defining a mounting portion;

a plurality of contacts disposed in the housing, each of said contacts defining a soldering section extending along a front-to-back direction;

a plurality of wires each defining an inner conductor aligned with the corresponding soldering section in a vertical direction perpendicular to said front-to-back direction;

the mounting portion defining a plurality of juxtaposed narrow slits respectively receiving the corresponding soldering sections, each of said slits further provided, in the vertical direction, with an enlarged wide open space communicating to an exterior; and a plurality of solders respectively disposed within the corresponding wide open spaces, wherein said solder is heated to reflow to join the inner conductor and the corresponding soldering section together; wherein the enlarged wide open space extends downward toward and reaches a plane where the soldering section is seated so as to allow the reflowed solder to be attached to lateral sides of both said inner conductor and said soldering section.

10. The cable connector assembly as claimed in claim 9, wherein before the solder is heated to reflow, the solder and the soldering section are respectively located by two sides of the corresponding inner conductor in said vertical direction.

* * * * *